US005191736A

United States Patent [19]

Iino et al.

[11] Patent Number: 5,191,736

[45] Date of Patent: Mar. 9, 1993

[54] CABINET WITH DOOR SEAL

[75] Inventors: Katsuyoshi Iino; Ryoichi Takahashi, both of Maebashi; Shoji Takeuchi, Gunma, all of Japan

[73] Assignee: Sanden Corporation, Gunma, Japan

[21] Appl. No.: 729,874

[22] Filed: Jul. 11, 1991

Related U.S. Application Data

[60] Continuation of Ser. No. 543,534, Jun. 26, 1990, abandoned, which is a division of Ser. No. 378,029, Jul. 11, 1989, abandoned.

[30] Foreign Application Priority Data

| | | | |
|---|---|---|---|
| Jul. 12, 1988 | [JP] | Japan | 63-92183 |
| Jul. 12, 1988 | [JP] | Japan | 63-92184 |
| Jul. 12, 1988 | [JP] | Japan | 63-92188 |
| Jul. 18, 1988 | [JP] | Japan | 63-94078 |

[51] Int. Cl.[5] ..... E06B 7/16

[52] U.S. Cl. ..... 49/484.1; 49/504

[58] Field of Search ..... 49/486, 504, 505, 489

[56] References Cited

U.S. PATENT DOCUMENTS

| | | | |
|---|---|---|---|
| 786,837 | 4/1905 | Pollard . | |
| 2,007,065 | 7/1935 | Walker | 220/55 |
| 3,126,590 | 3/1964 | Monti | 49/486 |
| 3,231,055 | 1/1966 | Leach | 189/46 |
| 3,254,503 | 6/1966 | Rundell | 49/486 |
| 3,665,736 | 5/1972 | Wilson | 70/78 |
| 3,852,981 | 12/1974 | Koning | 70/2 |
| 4,604,831 | 8/1986 | Tunnicliffe | 49/489 |
| 4,768,816 | 9/1988 | Bakula | 292/218 |

FOREIGN PATENT DOCUMENTS

| | | | |
|---|---|---|---|
| 3525540 | 1/1987 | German Democratic Rep. | 49/486 |
| 57-39748 | 9/1982 | Japan . | |
| 57-43576 | 9/1982 | Japan . | |
| 61-30217 | 3/1986 | Japan . | |
| 61-18378 | 6/1986 | Japan . | |

*Primary Examiner*—Kenneth J. Dorner
*Assistant Examiner*—Gerald A. Anderson
*Attorney, Agent, or Firm*—Banner, Birch, McKie and Beckett

[57] ABSTRACT

A structure for locking a display case door including a door handle, a pair of support members supporting the end portions of the handle, a lower support member of which has a through hole, and a locking piece extendably and retractably below the lower support member and having a through hole capable of facing the though hole of the lower support member so that an arm of a lock can be inserted through the both through holes. Since the locking piece can be positioned below and within the lower support member, it does not become any obstruction to the customers. A structure for treating dew drops dropped from a door of a display case including a tray for catching the dropped dew drops, a dew drops scattering inhibitor plate on the front portion of the tray, and a guide path on the rear portion of the tray and sloped down toward a machine room. The dropped dew drops are prevented from being scattered by the inhibitor plate and the collected water quickly and efficiently guided into the machine room by the sloped guide path. A structure for easily attaching without screws a packing support plate to a display case frame at a door position wherein the display case frame has grooves at least on its both inner side surfaces and the packing support plate has flange portions to be inserted into the grooves.

8 Claims, 11 Drawing Sheets

CABINET WITH DOOR SEAL

This application is a continuation of application Ser. No. 07/543,534, filed Jun. 26, 1990, now abandoned which is a division of copending application Ser. No. 07/378,029, filed Jul. 11, 1989, now abandoned.

BACKGROUND OF THE INVENTION

1. Field of the Invention

The present invention relates among other things to structures for a door portion and its vicinity of a display case such as a structure for locking a door of the display case, structures for suppressing the bedewing on the door portion, structures for treating dew drops dropped from the door and the water collected from the dropped dew drops and structures for attaching a packing support plate on the door portion.

2. Description of the Prior Art

The conventional display case, for example, a display case for displaying refrigerated or frozen foods, has various problems with door structure and adjacent portion.

Firstly, the conventional display case has a structure for locking a door of the display case, for example, as shown in FIG. 12. In FIG. 12, a display case 101 has a goods removal opening 102 and a door 103 to open and close the opening. A locking piece 104 having a through hole 104*a* is attached to the lower surface of a frame 105 of door 103 via a screw 106. Another locking piece 107 having a through hole 107*a* is attached to an appropriate fixed portion of display case 101 below locking piece 104. Door 103 when closed is locked by inserting an arm 108*a* of a lock 108, such as a padlock. In such a structure for locking door 103, however, since both locking pieces 104 and 107 project out from display case 101, the customer's clothes often catch on the locking pieces or the tips of the locking pieces jab the customer There is another problem with the conventional structure shown in FIG. 12. Door frame 105 is usually constructed from a ferrous material Since ferrous material has a high thermal conductivity, door frame 105 is cooled as is the inside of display case 101 when the display case is built in a refrigerator-freezer display case unit. As a result, dew forms on the front surface of door frame 105. Moreover, since a handle 109 usually attached to door frame 105 is also cooled by the door frame having a high thermal conductivity, it is uncomfortable for the customer to touch the handle to open or shut door 103.

There is another problem that the dew drops forming on door 103 drop down from the lower surface of the door onto and collect on the floor. To remedy this problem, a catch tray has been provided below the display case door as is disclosed in Japanese Utility Model Publication SHO 62-143175. However, particularly when the distance between the lower surface of the door and the tray is great, the dew drops dropping onto the tray are likely to splash in front of the display case. Further, it is desirable for the conventional tray to quickly and efficiently direct the dew drop water on the tray into a machine room which is usually provided below the display case, especially when a large amount of the water collects, as when it is humid.

Furthermore, there is a problem with the structure which attaches the packing support plate on the door portion. The packing support plate supports a packing provided for sealing the inside of a showcase at a portion of a door, and the packing support plate is usually screwed to a display case frame defining a goods removal opening of the display case. In such a conventional attachment structure of the packing support plate, however, since a tool such as a screwdriver is required for attaching the plate, much time is needed to attach or exchange the plate.

SUMMARY OF THE INVENTION

Accordingly, an object of the present invention is to provide a structure of a door portion of a display case for locking a door wherein locking pieces to be attached with a lock do not project far from the display case and/or the door, thereby preventing the clothes or the body of a customer from contacting the locking pieces.

Another object of the present invention is to provide a structure for minimizing the dew formation on a door portion.

A further object of the present invention is to provide a structure for preventing dew drops dropping from a door of a display case from splashing and the water due to the dropped dew drops is quickly and efficiently guided into a machine room located below the display case.

A still further object of the present invention is to provide a structure for attaching a packing support plate to a display case frame on a door portion so that the packing support plate can be easily attached and exchanged without using screws or screwdrivers.

Directed to achieving these objects, structures for a door portion and its vicinity of a display case are herein provided.

The display case has a goods removal opening and a door to open and close the goods removal opening. The display case comprises a handle extending vertically along the door, a pair of support members provided on a frame of the door for supporting upper and lower end portions of the handle, respectively, and a door locking piece provided on a fixed portion of the display case at a position below a lower support member on the door which is closed. The lower support member has a through hole. The locking piece is supported free to extend to the position below the lower support member and retract from the extended position to a position in the fixed portion. The locking piece has a through hole adapted to face the through hole of the lower support member when the door is closed so that an arm of a lock may be penetrated through both the through holes.

In the structure for locking the door of the display case, the locking piece on the fixed portion of the display case is retracted to the position in the fixed portion when the door is not locked. Therefore, the locking piece does not interfere with the customer. When the door is locked, the locking piece is extended to and placed at the position below the lower support member on the door which is closed, and the lock is attached to the lower support member and the locking piece. In this locking state, since the lower support member, the locking piece and the lock are located at the position directly under the handle and the locking piece may be extended only within the extent of the lower support member in its extending direction, the locking piece and the lock do not interfere with the customer. As a result, the locking piece and/or the lock can be prevented from catching and touching the customer's clothes or body.

In a structure for a door portion of a display case according to the present invention, a door frame is preferably constructed from a plastic such as a synthetic resin. In such a structure, since the thermal conductivity of the door frame is considerably lower than that of the conventional metal door frame, the door frame is not cooled greatly, and the dew formation on the door portion, particularly on the door frame, is minimized. A handle connected to the door frame also is not cooled greatly, and the cold uncomfortable feeling given to a customer who touches the handle is thereby prevented.

Further, another display case structure is provided for a refrigerator-freezer unit which has a lower machine room for a refrigerator and an upper cold room as a display compartment for goods. The unit comprises a tray disposed below a door of the cold room for catching dew drops dropping from the door, a dew drops scattering inhibitor plate provided on the tray in front of where the dew drops drop, and a guide path on a rear portion of the tray for guiding the dew drop water collected on the tray into the machine room. The guide path slopes downwardly toward the machine room.

In such a structure for treating dew drops dropped from the door of the display compartment, the dew drops dropped onto the tray can be prevented from being scattered by the dew drops scattering inhibitor plate provided on the front portion of the tray. The water generated on the tray by the dropped dew drops quickly and efficiently flows into the machine room along the sloping guide path.

Furthermore, a structure of a display case is provided for attaching a packing support plate to a display case frame. The display case comprises a frame substantially defining a goods removal opening and a packing support plate attached with a packing for sealing the inside of the display case at a position of a door. The display case frame has grooves vertically extending at least on both inner side surfaces of the frame through substantially the entire lengths of the both inner side surfaces. Flange portions of the packing support plate are inserted into the grooves and fitted to the frame in the grooves.

In such a structure for attaching the packing support plate, since the packing support plate is fixed to the display case frame only by inserting the flange portions into the grooves on the inner side surfaces of the frame, the plate can be easily and quickly attached or exchanged without using screws or screwdrivers.

BRIEF DESCRIPTION OF THE DRAWINGS

Preferred exemplary embodiments of the invention will now be described with reference to the accompanying drawings which are given by way of example only, and thus are not intended to limit the present invention.

DETAILED DESCRIPTION OF PREFERRED EMBODIMENTS OF THE PRESENT INVENTION

Figure 1:
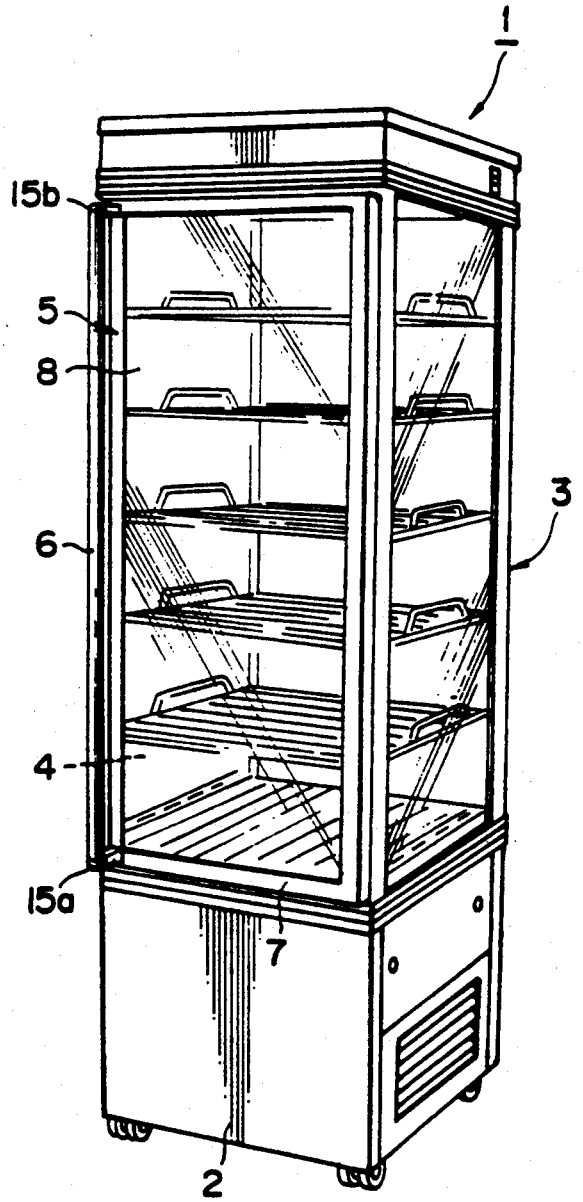
FIG. 1 is a perspective view of a display case according to one embodiment of the present invention
Figure 2:
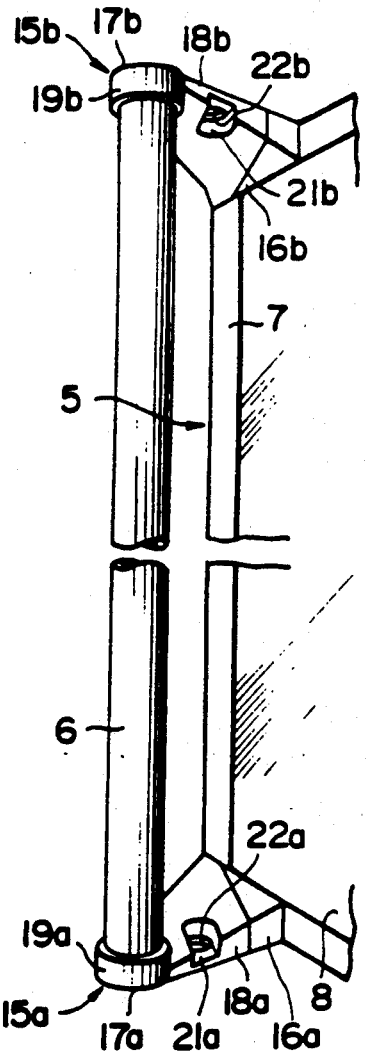
FIG. 2 is an enlarged perspective view of a portion of the display case shown in FIG. 1.
Figure 3:
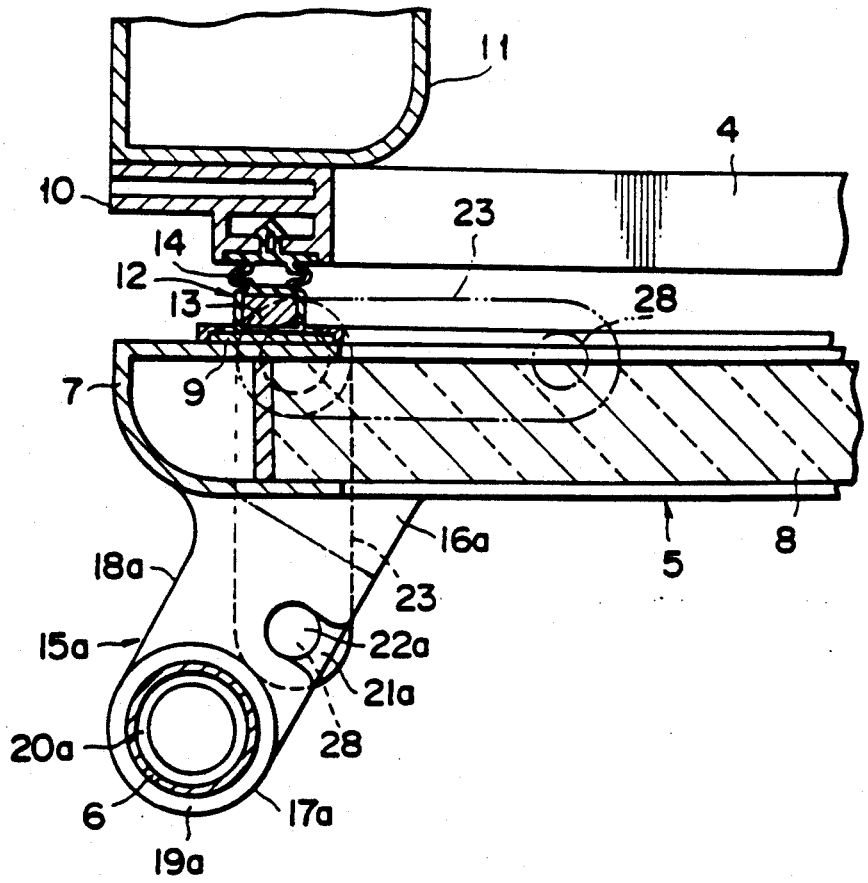
FIG. 3 is an enlarged cross-sectional view of a portion of the display case shown in FIG. 1.

Referring to the drawings, FIGS. 1–4 illustrate a display case according to one embodiment of the present invention. As shown in FIG. 1, a refrigerator-freezer display case unit 1 has a machine room 2 on the lower portion thereof for placing a cooling unit (not shown) in the room and a display case 3 on the upper portion thereof for containing the goods to be cooled. Display case 3 has a goods removal opening 4 and a door 5 to open and close the opening. In this embodiment, door 5 comprises a right-hinged door, and a handle 6 extends vertically along a left end portion of the door.

Door 5 comprises a rectangularly-shaped door frame 7 constructed from a synthetic resin and a glass plate 8 held in the door frame. An attraction plate 9 constructed from a ferrous material is attached to the back surface of door frame 7 substantially along the entire circumferential length of the door frame. A packing support plate 10 is fixed to a display case frame 11, substantially defining goods removal opening 4, along the display case frame. A magnetic packing 12 which comprises a magnet 13 and an elastomer 14 enclosing the magnet is attached to packing support plate 10. The magnetic packing 12 attracts attraction plate 9 when door 5 is closed and seals the inside of display case 3 at the door portion.

Support members 15*a* and 15*b* on the front surface of door frame 7 support the upper and lower end portions of handle 6, respectively, and are also constructed from a synthetic resin. Support members 15*a* and 15*b* comprise fixed portions 16*a* and 16*b* connected to door frame 7, support portions 17*a* and 17*b* connected to handle 6 and connecting portions 18*a* and 18*b* connecting the fixed portions and the support portions, respectively. Support portions 17*a* and 17*b* have outer cylinders 19*a* and 19*b* and inner cylinders 20*a* and 20*b* spaced from the outer cylinders, respectively. The lower end portion of handle 6 is inserted and fixed between outer cylinder 19*a* and inner cylinder 20*a* and the upper end portion of the handle is inserted and fixed between outer cylinder 19*b* and inner cylinder 20*b*, respectively. Recessed portions 21*a* and 21*b* are formed on the upper surface of lower connecting portion 18*a* and on the lower surface of upper connecting portion 18*b*, respectively. In this embodiment, vertical through holes 22*a* and 22*b* are provided on the bottom portions of both recessed portions 21*a* and 21*b*, respectively. This through hole may however be provided only on lower support member 15*a*.

A piece 23 for locking door 5 is provided on a support member 24 fixed onto a bottom plate 25 of display case 3 which constitutes a fixed portion of the display case. This locking piece 23 is located below lower support member 15*a* fixed to door 5 when the door is closed. Locking piece 23 is supported free to extend to the position below lower support member 15*a* and retract from the extended position to a position within bottom plate 25, more specifically, supported free to swing between the extended position and the retracted position around a shaft 26 fixed on support member 24. A screw 27 holds locking piece 23 to shaft 26. Locking piece 23 has a vertical through hole 28 which can face through hole 22*a* of lower support member 15*a* when locking piece 23 is in its extended position and door 5 is closed.

Figure 4:
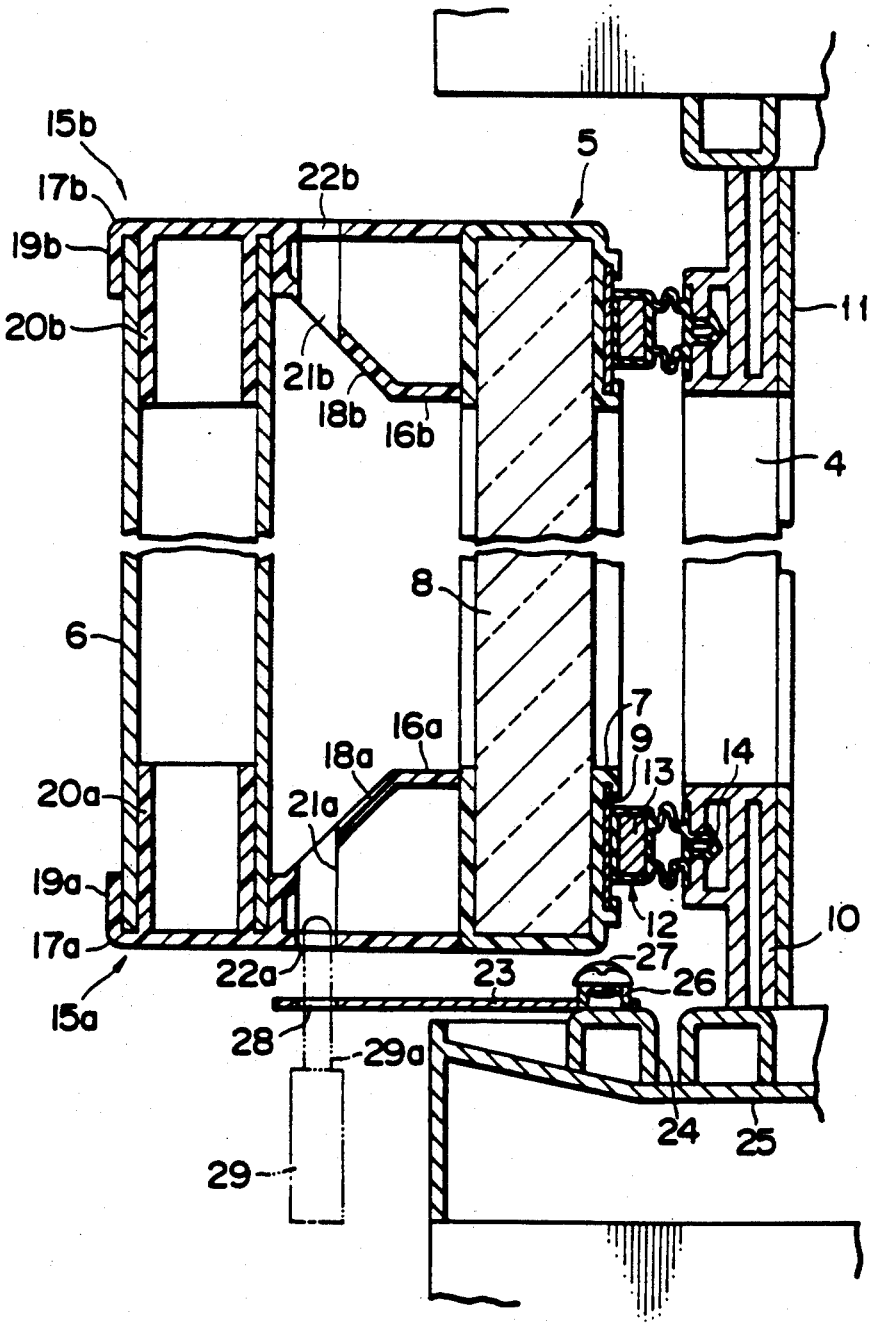
FIG. 4 is an enlarged vertical sectional view of a portion of the display case shown in FIG. 1.

In this embodiment, when door 5 is unlocked, locking piece 23 is swung to its retracted position within bottom plate 25 of display case 3. Since locking piece 23 does not project to any extent from display case 3, it does not obstruct the customer when door 5 is opened or closed. When door 5 is locked, however, locking piece 23 is swung to its extended position and the door is closed. The locking piece 23 is then adjusted in its position so that through hole 28 accurately meets through hole 22*a* of lower support member 15*a*. Thereafter, an arm 29*a* of a lock (padlock) 29 is extended through both through holes 22*a* and 28, as shown in FIG. 4, and, door 5 is thereby locked.

In this structure for locking door 5, since locking piece 23 is located directly below lower support member 15*a* and the piece may project only within the projection area of the lower support member so that both through holes 22*a* and 28 face each other, the locking piece does not catch the clothes of a customer and does not touch the body of the customer. Since lock 29 is also located substantially within the position of lower support member 15*a*, the lock also does not obstruct the customer.

Moreover, in this embodiment, since door frame 7 is constructed from a synthetic resin, the door frame has a thermal conductivity considerably lower than that of the conventional metal door frame. Therefore, the bedewing on door frame 7 can be reduced greatly. Furthermore, since support members 15*a* and 15*b* are also constructed from a synthetic resin having a low thermal conductivity, the cooling of handle 6 is minimized, and the annoying feeling when the customer touches a cold handle reduced.

Figure 5:
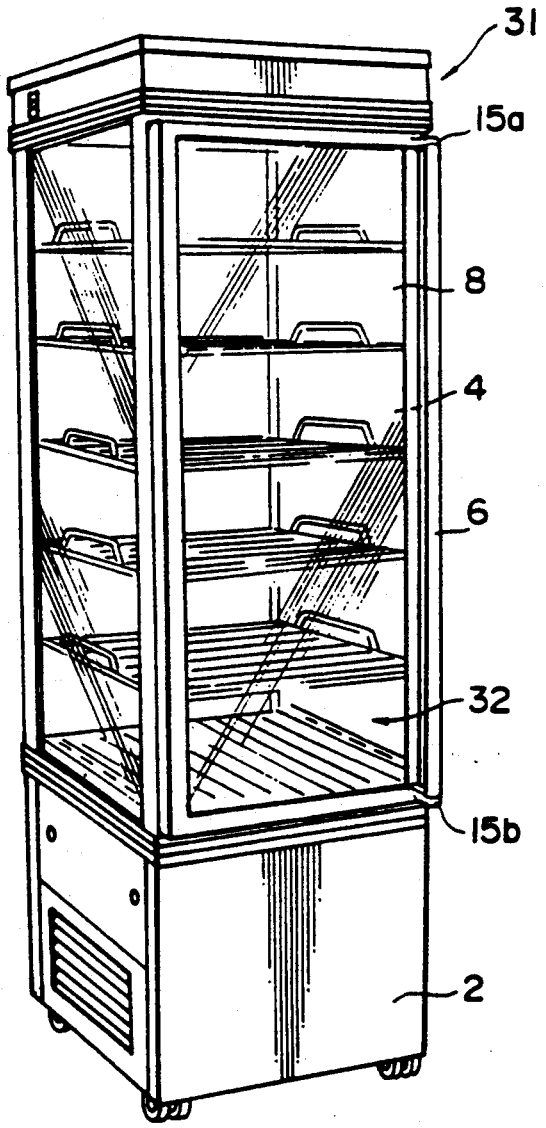
FIG. 5 is a perspective view of a display case according to another embodiment of the present invention.

In this embodiment, since upper support member 15*b* also has through hole 22*b*, the pair of support members 15*a* and 15*b* or the assembly of the pair of support members and handle 6 are applied to a display case 31 having a left-hinged door 32 as shown in FIG. 5. In this case, upper support member 15*b* is positioned at the lower end of handle 6 and lower support member 15*a* is positioned at the upper end of the handle. In this modification, a structure for locking door 32 similar to the aforementioned locking structure can also be used. Of course, when the direction for opening a door is fixed, only a lower support member may have a through hole for locking the door.

Figure 6:
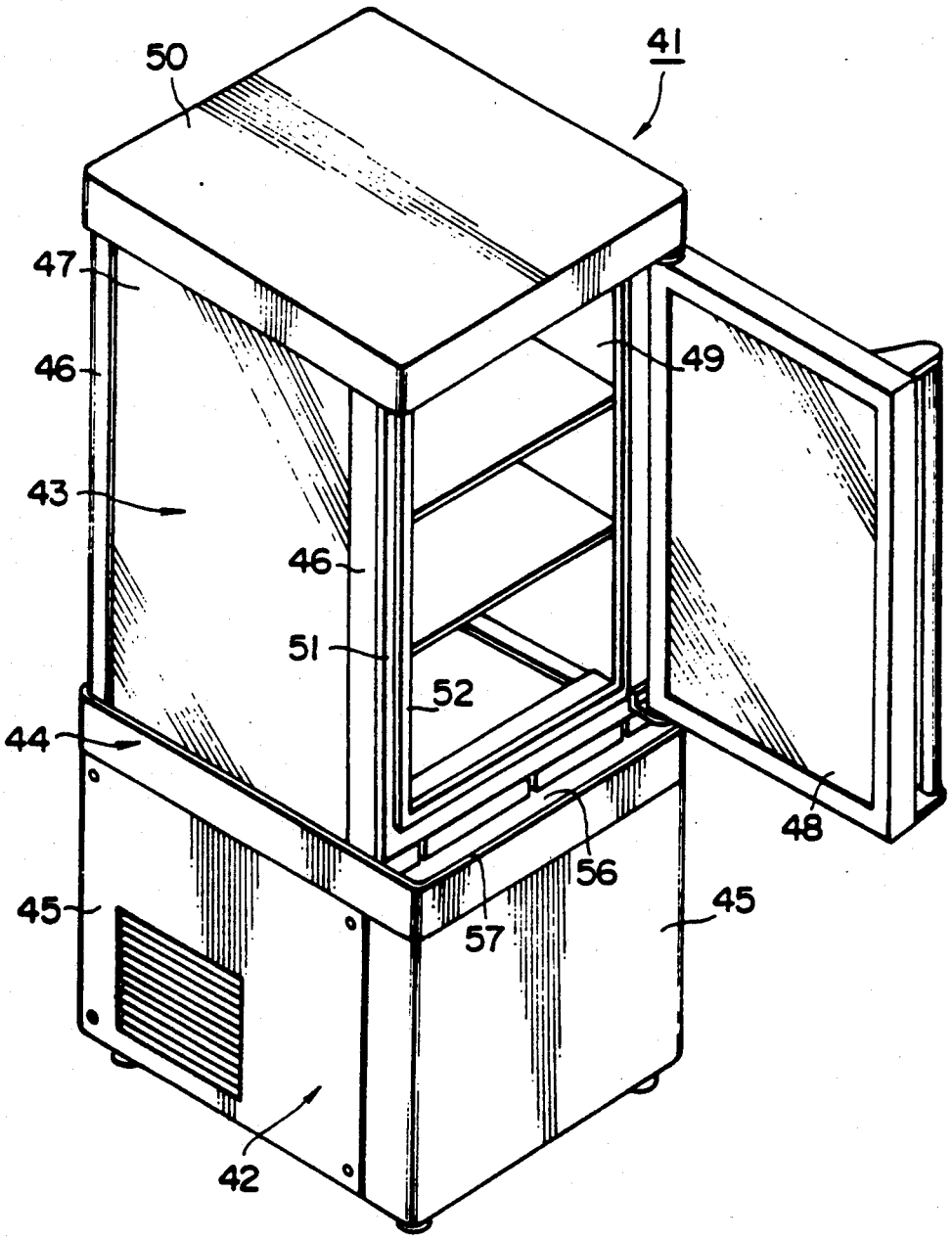
FIG. 6 is a perspective view of a refrigerator-freezer unit according to a further embodiment of the present invention.
Figure 7:
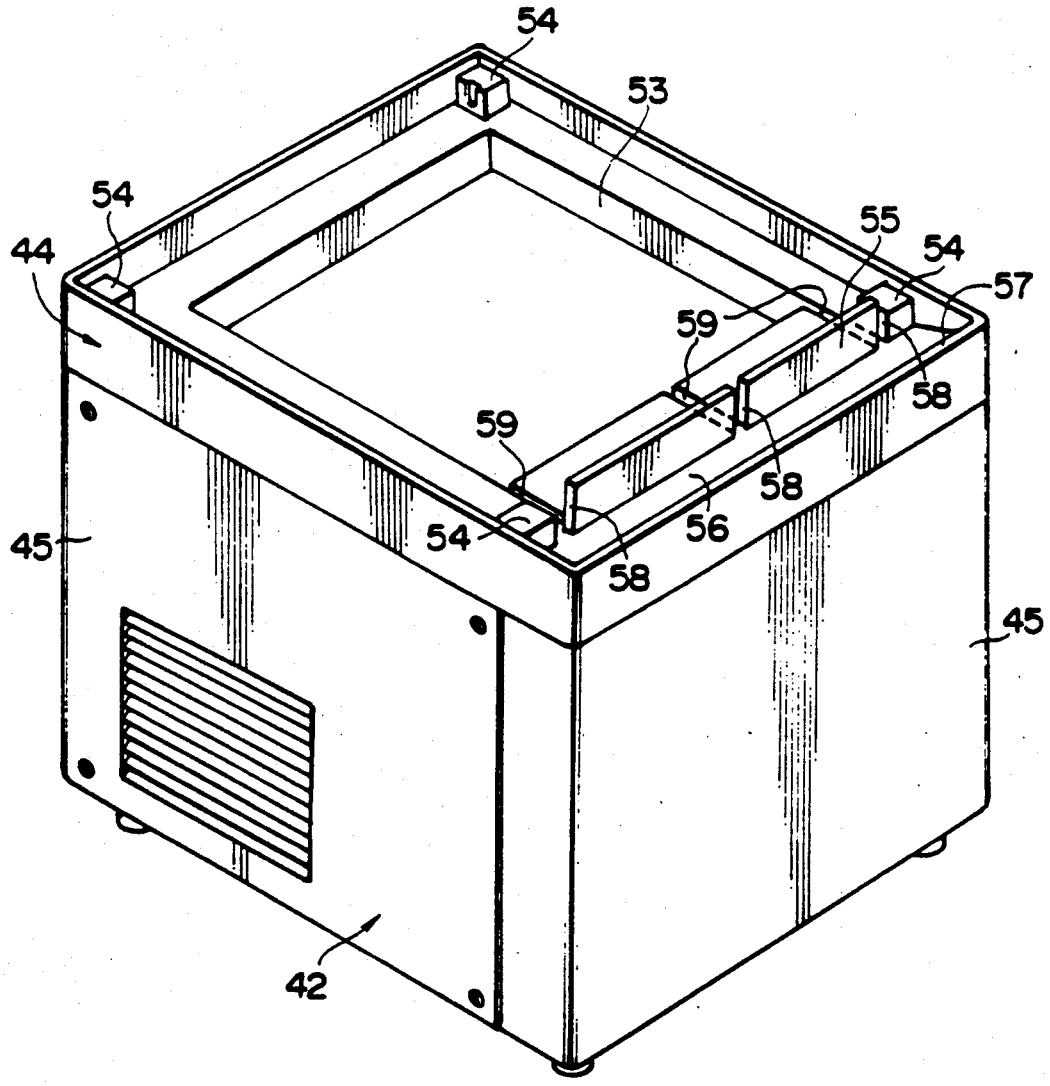
FIG. 7 is an enlarged perspective view of a portion of the unit shown in FIG. 6.
Figure 8:
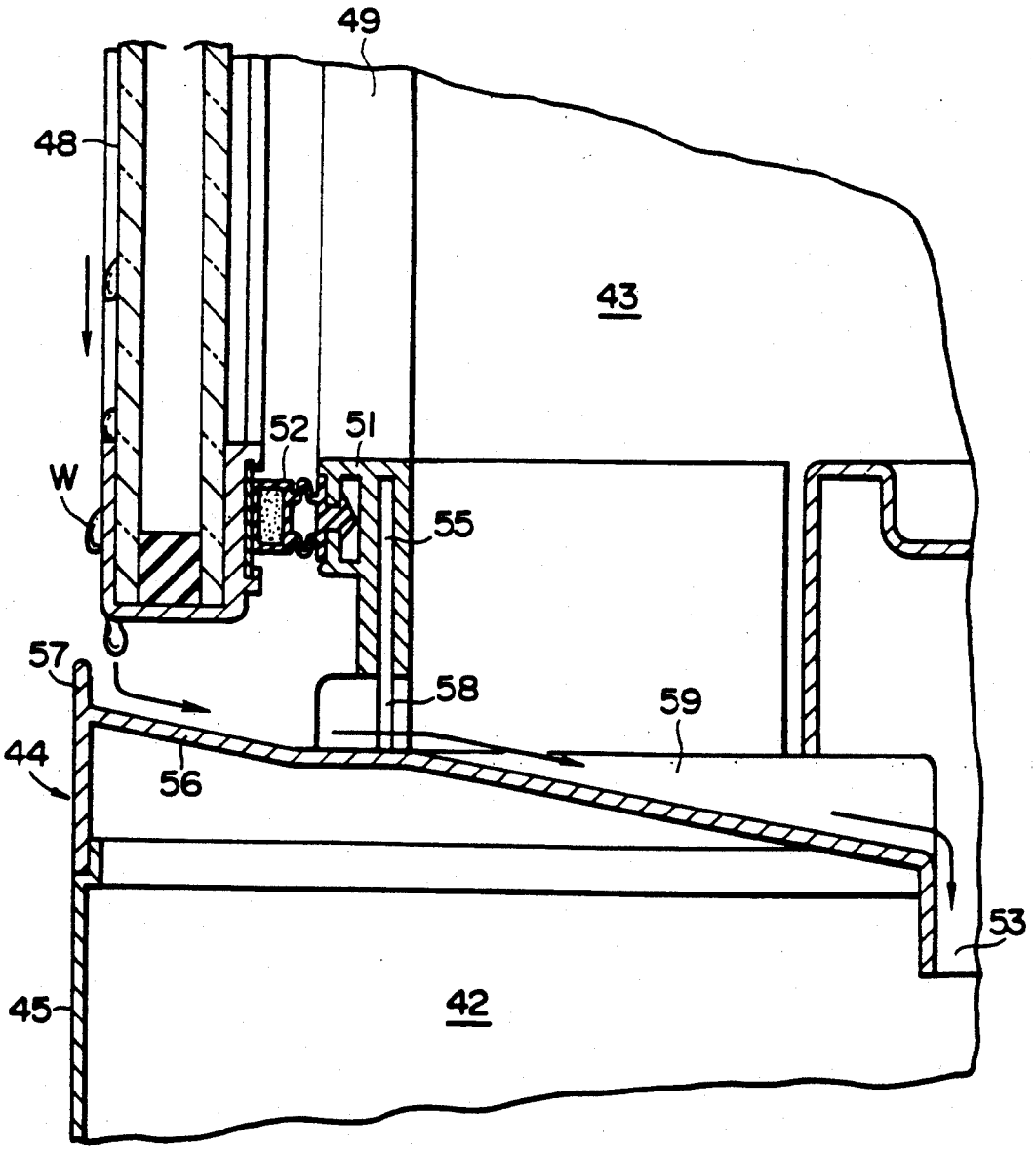
FIG. 8 is an enlarged vertical sectional view of a portion of the unit shown in FIG. 6.

FIGS. 6–8 illustrate a refrigerator-freezer display case unit according to another embodiment of the present invention. As shown in FIG. 6, a refrigerator-freezer display case unit 41 has a lower machine room 42 and also an upper cold room 43 providing a compartment for displaying goods, and a frame 44 is disposed between the machine room and the cold room.

Machine room 42 is covered with cover plates 45, and a refrigerator (not shown) comprising a compressor, a condenser, an expansion means, an evaporator and a blower means is positioned in the machine room. Cold room 43 comprises four vertical pillars 46, three glass plates 47 disposed between a pair of pillars 46, a door 48 opening and closing a goods removal opening 49 of the cold room, and a roof plate 50. A packing support plate 51 with a magnetic packing 52 is attached on a portion of goods removal opening 49. The magnetic packing 52 attracts the back surface of door 48 and seals the inside of cold room 43 when the door is closed. Frame 44 has a hole 53 communicating with the inside space of machine room 42 on its central portion and four fitting tubes 54 on its four corners which connect the pillars (not shown) of the machine room and pillars 46 of cold room 43. In this embodiment, a support plate 55 is provided on frame 44 and the lower portion of packing support plate 51 is attached to and fitted onto the support plate.

A tray 56 for catching dew drops W (FIG. 8) falling from door 48 is provided below the door, and the tray is formed on and integrally with frame 44. A dew drops scattering inhibitor plate 57 is provided on tray 56 at a position in front of where the dew drops drop from door 48. Dew drops scattering inhibitor plate 57 extends vertically upwardly and is integrally formed with tray 56 in this embodiment.

Vertical slits 58 are defined on support plate 55 and between the both sides of the support plate and fitting tubes 54. Guide path grooves 59 are formed on the rear portion of tray 56, communicate with slits 58, and slope down toward machine room 42. In this embodiment, the upper surface of tray 56 in front of support plate 55 also slopes down in the same direction as that of grooves 59.

In this embodiment when door 48 is cooled by the temperature in cold room 43, water vapor in the atmosphere condenses on the outer surface of the door and dew drops W form on the door. The dew drops W flow down along the outer surface of door 48 and drop from the lower end of the door onto tray 56 as shown by the arrows in FIG. 8. Although the dropped dew drops are likely to splash or be scattered, dew drops scattering inhibitor plate 57 prevents them from being scattered forwardly. The water on tray 56 from the dropped dew drops flows down the sloped upper surface of the tray toward slits 58. After passing through slits 58, the water flows into grooves 59, flows down along the grooves and is guided into the inside space of machine room 42. The water flowing into machine room 42 is discharged to a drain tank (not shown) together with fluid from the drain of the refrigerator. Thus, the scattering of the dropped dew drops is easily prevented and the water from the dropped dew drops quickly and efficiently guided by the sloped guide path into machine room 42.

Figure 9:
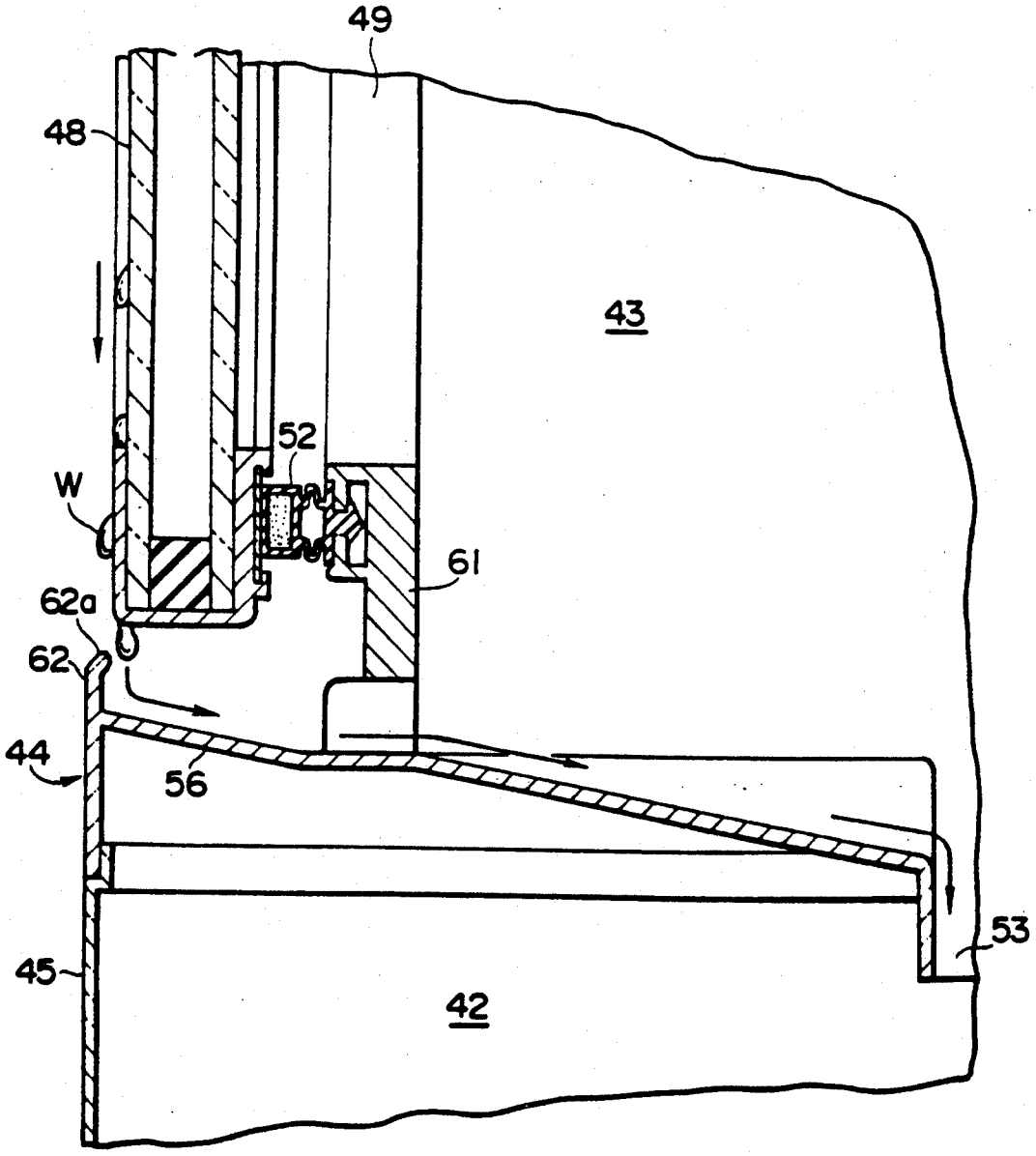
FIG. 9 is a vertical sectional view of a portion of a refrigerator-freezer unit according to a further embodiment of the present invention.

Although support plate 55 is provided on tray 56 in this embodiment, the support plate and slits 58 may be omitted when a packing support plate 61 is supported on, for example, the pillars of cold room 43, as shown in FIG. 9. Also the groove 59 can have any width, for example it can be substantially equal to the entire width of tray 56. Moreover, various modifications of the shape of dew drops scattering inhibitor plate 57 are within the scope of this invention. The height of dew drops scattering inhibitor plate 57 may be appropriately chosen in accordance with the distance between the lower end of door 48 and the upper surface of tray 56. A top portion 62a of a dew drops scattering inhibitor plate 62 may be bent toward the rear portion of tray 56, as shown in FIG. 9, to more effectively prevent the dropped dew drops from scattering.

Figure 10:
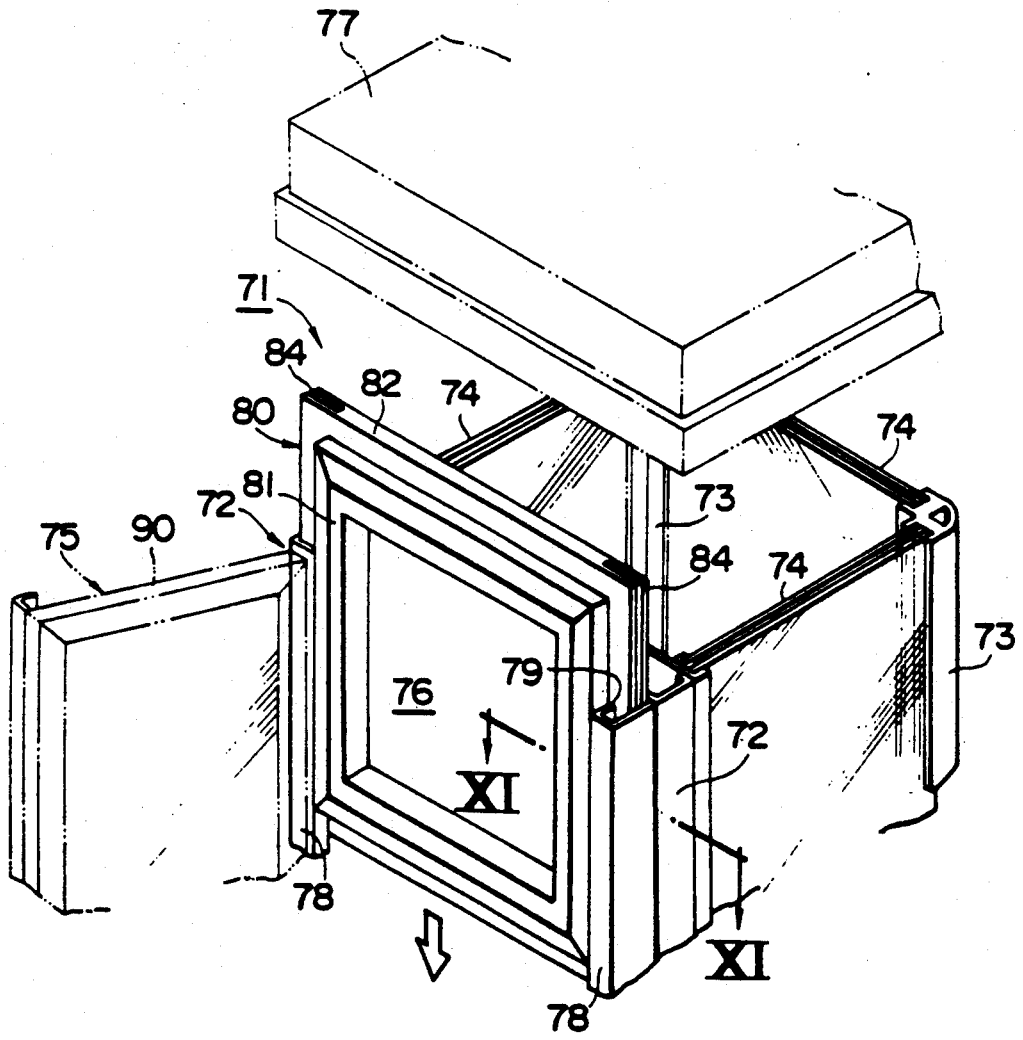
FIG. 10 is an exploded perspective view of a portion of a display case according to a further embodiment of the present invention.
Figure 11:
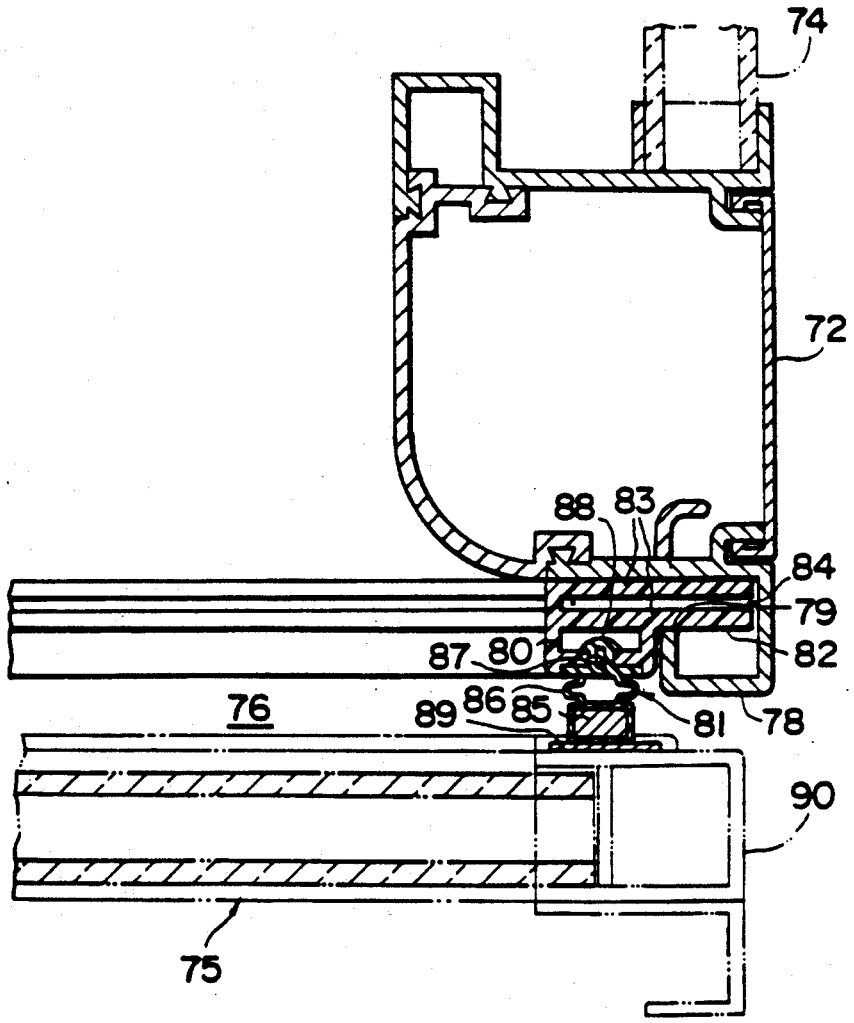
FIG. 11 is an enlarged cross-sectional view of a portion of the display case shown in FIG. 10 taken along line XI—XI of FIG. 10.
Figure 12:
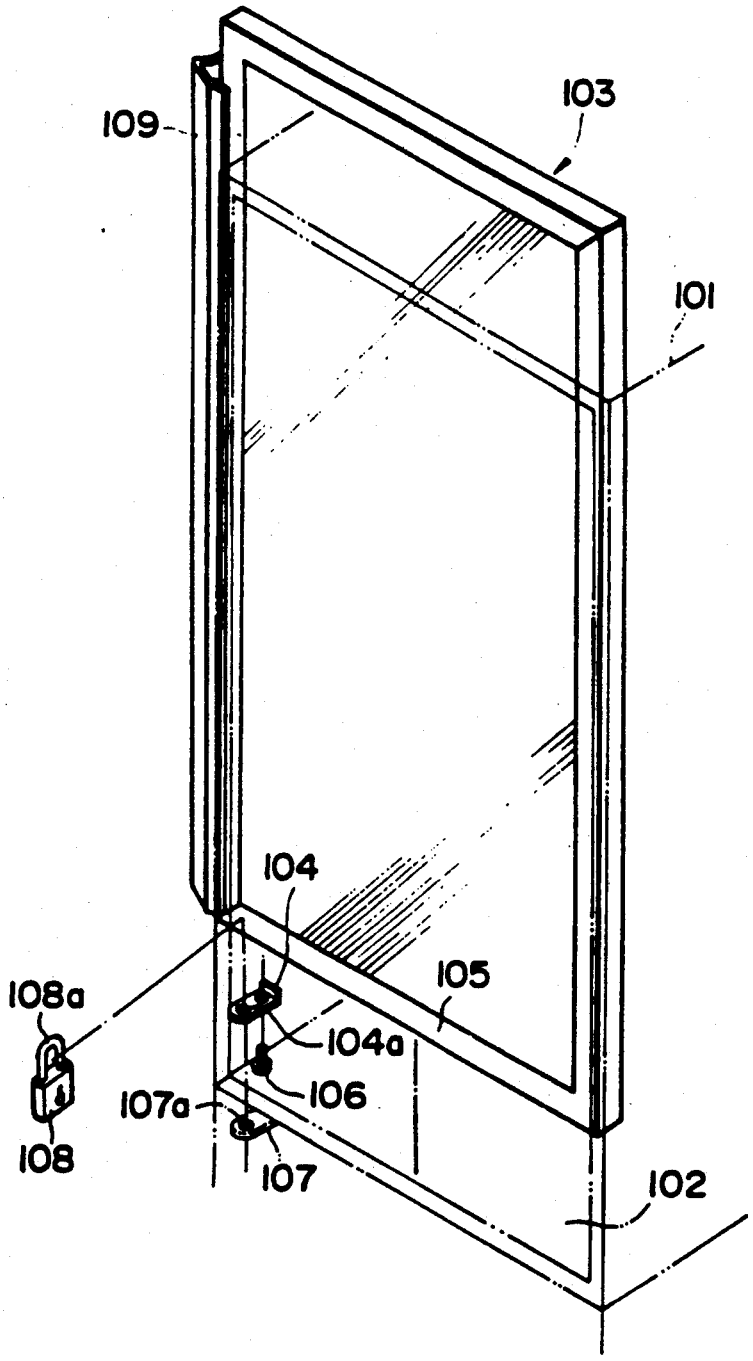
FIG. 12 PRIOR ART
FIG. 12 is an exploded perspective view of a portion of a conventional display case.

FIGS. 10 and 11 illustrate the upper portion of a display case according to a further embodiment of the present invention. The display case 71 of this embodiment comprises two front pillars 72, two rear pillars 73, three glass plates 74, a door 75 opening and closing a goods removal opening 76, and a roof plate 77. A channel 78 having a groove 79 opening inwardly of goods removal opening 76 is attached to the front side of each front pillar 72. This channel 78 and front pillar 72 are integrally assembled and constitute a, part of a frame substantially defining goods removal or access opening 76. In this embodiment, grooves 79 are provided on both inner side surfaces of channels 78 positioned on both sides of goods removal opening 76, and the grooves extend vertically along substantially the entire length of the both inner side surfaces of the channels.

A packing support plate 80 with a magnetic packing 81 is attached to channels 78. Packing support plate 80 has periphery flange portions 82, each of which positioned on both sides of the packing support plate comprises a pair of plain plate portions 83 and a slit 84 defined between the pair of plain plate portions. Magnetic packing 81 comprises a magnet 85 and an elastomer 86 enclosing the magnet. A groove 87 is formed on the front surface of packing support plate 80 over the entire circumferential length of the packing support plate. Magnetic packing 81 is attached to packing support plate 80 along groove 87 by inserting a projection 88 formed on the back surface of the packing into the groove. This magnetic packing 81 attracts a metal plate 89 attached on the back surface of a door frame 90 of door 75 and seals the inside of display case 71 when the door is closed.

In this embodiment, packing support plate 80 is attached to channels 78 positioned on both sides of goods removal opening 76 only by inserting flange portions 82 on both sides of the packing support plate into grooves 79 downwardly from upper side. Therefore, packing support plate 80 can be easily fixed without using screws or screwdrivers. Particularly in this embodiment, since packing support plate 80 is constructed from a plastic and a pair of plain plate portions 83 spaced from each other by slit 84 can have an elasticity in the thickness direction, the flange portions 82 with the pair of plain plate portions are smoothly inserted into grooves 79 and surely and strongly fitted to channels 78 in the grooves of the channels.

The lower end portion of packing support plate 80 is supported on a bottom plate or an intermediate partition plate (not shown) of display case 71. For this supporting, a groove for inserting the lower end portion of packing support plate 80 thereinto is preferably formed on the front end portion of the bottom plate or the intermediate partition plate. The upper end portion of packing support plate 80 is fixed by roof plate 77 when the roof plate is assembled after the packing support plate is fixed to channels 78. A groove for inserting the upper end portion (flange portion) of packing support plate 80 thereinto may be formed on the lower surface of roof plate 77.

This structure for attaching a packing support plate without using screws can be applied to any type of display case, for example, a display case of a refrigerator-freezer display case unit, a display case of refrigerator-warmer display case unit having a cooling unit and a warming unit with a hot plate, and the like.

Although several preferred embodiments of the present invention have been described herein in detail, it will be appreciated by those skilled in the art that various modifications and alterations can be made to them without materially departing from the novel teachings and advantages of this invention. Accordingly, it is to be understood that all such modifications and alterations are within the scope of the invention as defined by the following claims.

What is claimed is:

1. A display case comprising:

a goods display compartment;

a frame fixedly mounted to said compartment, said frame enclosing an access opening providing access to said compartment, said frame having two inner side surfaces on opposite sides of said access opening generally facing each other;

a door which opens and closes said access opening; and a seal support plate extending transversely of said access opening between said inner side surfaces, said seal support plate having connected thereto a sealing means for sealing said compartment at a portion of said door, at least one of said seal support plate or said frame inner side surfaces having grooves extending to an outer end thereof, and the other of said seal support plate or said frame inner side surfaces having flange portions extending therealong, whereby said flange portions are fitted into said grooves from said outer end for laterally removably attaching said seal support plate to said frame;

said seal support plate having an opening therethrough; and said sealing means being connected to said seal support plate and extending substantially around the periphery of said opening therein.

2. The display case of claim 1 wherein said seal support plate is generally rectangular.

3. The display case of claim 2 wherein said flange portions comprise a pair of generally parallel spaced plates defining a slit therebetween.

4. The display case of claim 3 wherein said grooves are in said inner side surfaces of said frame and said flange portions extend outwardly from opposite side of said seal support plate.

5. The display case of claim 4 wherein said outer end is the top end of said inner side surfaces such that said flange portions on said seal support plate are inserted downwardly into said grooves;

wherein the lowermost side of said seal support plate is supported on a bottom plate of said goods display compartment; and further comprising:

a flange portion extending from the uppermost side of said seal support plate; and a removable roof plate for said goods display compartment extending over the top of said seal support plate, said roof plate having a groove for inserting said flange portion of the uppermost side of said seal support plate.

6. A display case comprising:

a goods display compartment having an opening therein;

a door which opens and closes said opening;

a seal support plate supporting a sealing means for sealing said opening when said door is closed;

said seal support plate extending transversely of said access opening in said compartment and opening an therein providing access to the interior of said compartment through said compartment opening;

said sealing means comprising an attachment packing extending about said seal support plate opening and being connected to said seal support plate;

said door contacting said attachment packing such that said seal support plate opening is substantially sealed when said door is closed; and a slidable securing means for sliding said seal support plate to an inserted position where said seal support plate is secured to said compartment such that said seal support plate can be slidably inserted and removed, said slidable securing means having a restraining means for restraining removal of said support plate in a direction normal to a surface defined by said opening such that the seal support plate is restrained form undesired removal in the normal direction.

7. The display case of claim 6 wherein said seal support plate is substantially rectangular and said seal support plate opening spans across a substantial portion of said seal support plate; and wherein said seal support pate is unitary substantially rigid member.

8. The display case of claim 7 wherein said slidable securing means comprises said seal support plate at a perimeter of said seal support plate, said perimeter being a permitter as viewed in a direction of said opening.

* * * * *